US006668476B1

(12) United States Patent
Gaines et al.

(10) Patent No.: US 6,668,476 B1
(45) Date of Patent: Dec. 30, 2003

(54) ADDRESS SIGN WITH ACCOMMODATING CHARACTERS

(76) Inventors: Theodore E. Gaines, 12200 Kirkham Rd., Poway, CA (US) 92064; Donald B. Gaines, P.O. Box 1106, Rancho Santa Fe, CA (US) 92067

( * ) Notice: Subject to any disclaimer, the term of this patent is extended or adjusted under 35 U.S.C. 154(b) by 0 days.

(21) Appl. No.: 09/999,496

(22) Filed: Nov. 30, 2001

(51) Int. Cl.[7] ..... G09F 15/00

(52) U.S. Cl. ..... 40/618; 40/607.1; 40/620

(58) Field of Search ..... 40/606, 607, 618, 40/620, 607.1, 607.01, 611.01, 607.13

(56) References Cited

U.S. PATENT DOCUMENTS

| | | | | | |
|---|---|---|---|---|---|
| 2,829,458 | A | * | 4/1958 | Marcin | 40/618 |
| 3,874,978 | A | * | 4/1975 | Naiman | 428/13 |
| 4,048,738 | A | | 9/1977 | McHenry | 40/16 |
| 4,137,657 | A | * | 2/1979 | Wardle | 40/1.5 |
| 4,138,787 | A | * | 2/1979 | Sarkisian et al. | 40/618 |
| 4,179,688 | A | * | 12/1979 | Romney | 29/445 |
| 4,229,894 | A | | 10/1980 | Beck | 40/579 |
| 4,265,040 | A | * | 5/1981 | Sarkisian | 40/618 |
| 4,392,317 | A | * | 7/1983 | Boothman | 40/618 |
| 4,450,640 | A | * | 5/1984 | Shapiro et al. | 40/596 |
| 4,604,820 | A | | 8/1986 | Edman | 40/605 |
| 5,265,363 | A | * | 11/1993 | Martin | 40/605 |
| 5,400,535 | A | * | 3/1995 | Schomaker | 40/607 |
| 5,555,660 | A | * | 9/1996 | Whitehouse et al. | 40/622 |
| 5,581,922 | A | * | 12/1996 | Heimann | 40/605 |
| 5,832,642 | A | | 11/1998 | Dalton | 40/546 |
| 5,865,627 | A | * | 2/1999 | Foresman | 434/193 |
| 5,890,306 | A | | 4/1999 | Smith | 40/576 |
| 6,108,955 | A | * | 8/2000 | Folsom et al. | 40/618 |
| 6,459,952 | B1 | * | 10/2002 | Dundorf | 700/182 |

OTHER PUBLICATIONS

FRONTGATE, Frontgate retail catalog, prior to Nov. 1, 2001, p. 72, Cornerstone Brands, Inc., U.S.A.
FRONTGATE, Frontgate retail catalog, prior to Nov. 1, 2001, p. 84, Cornerstone Brands, Inc., U.S.A.
FRONTGATE.COM, internet website, prior to Nov. 1, 2001 (current printout provided as representative of pre–Nov. 1, 2001 content), Whitehall Products, U.S.A. and world–Wide.
WHITEHALL PROCUCTS.COM, internet website, prior to Nov. 1, 2001 (current printout provided as representative of pre–Nov. 1, 2001 content), Whitehall Products, U.S.A. and world–wide.
WHITEHALL PRODUCTS, product brochure, prior to Feb. 9, 2001, Whitehall products, U.S.A.
WHITEHALL PRODUCTS, product brochure, prior to Nov. 1, 2001, Whitehall Products, U.S.A.
UNKNOWN, address plaque products on sale prior to Nov. 28, 2000 (numbers adhere to frame with glue or silicone, or are notched and slid into tracks on plaque), U.S.A. (no samples are available).

* cited by examiner

*Primary Examiner*—Lesley D. Morris
*Assistant Examiner*—Motilal Patel
(74) *Attorney, Agent, or Firm*—Henderson & Caverly LLP; Kristen E. Caverly

(57) ABSTRACT

An address display including a signboard, the signboard having defined therethrough at least three sets of punch-out holes, each set having at least one punch-out hole defined within, at least one punch-out hole of each set substantially collinear with at least one punch-out hole of each of the other sets, the punch-out holes along a line defined by the collinearity having substantially constant spacing; and a number of characters, each character to attach to respective ones of the at least three sets of holes, the characters each having a width and a height, the characters chosen from a set of characters corresponding to characters used in an address, each character in the set of characters having substantially the same overall width and substantially the same overall height as each of the other characters in the set of characters.

24 Claims, 7 Drawing Sheets

ADDRESS SIGN WITH ACCOMMODATING CHARACTERS

CROSS-REFERENCE TO RELATED APPLICATIONS

Not Applicable

SUMMARY REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

FIELD OF THE INVENTION

The present invention relates to signs for displaying addresses or other messages, and more particularly to signs that may display messages of variable length but with no degradation of message position or character spacing.

BACKGROUND OF THE INVENTION

The field of address signs is replete with examples of address signs that are illuminated, that accommodate a certain modularity, or that are combined with mailboxes.

For example, U.S. Pat. No. 4,229,894 discloses a street number display employing plates. The plates display the characters of the address and further have light passages therethrough so that a properly placed illumination source may serve to display the address in a dark environment.

As another example, U.S. Pat. No. 5,832,642 discloses a street number display employing characters that are mounted with light transmissive members disposed in light holes so as to pass light.

As a further example, U.S. Pat. No. 4,048,738 discloses a street number display employing plates. The plates forming the characters of the display may be interlaced with spacer plates so as to form a desired pattern.

Still further, U.S. Pat. No. 5,890,306 discloses a street number display employing plates. The plates forming the characters of the display may be mounted in either a vertical or a horizontal orientation for versatility.

Finally, U.S. Pat. No. 4,604,820 discloses a modular sign system. Panels of the sign may be removed and replaced in a modular fashion.

None of the above references discloses an address display system that is modular, can accommodate multiple numbers or letters of address characters, and yet endows such functionality with a highly attractive presentation.

BRIEF SUMMARY OF THE INVENTION

The present invention overcomes the disadvantages of the prior art noted above.

In particular, the present invention provides a sign-type display for a building, room and/or property address in which multiple characters of address may be accommodated, such as three numerals or letters, four numerals or letters, five numerals or letters, a combination of numerals and letters, etc. Each character is "automatically" spaced relative to the sign and other characters, if any, no matter what character is employed or what its location is.

Two of the primary features of the invention include the design of the signboard and the design of the characters, in particular the location of the fixtures used to attach the numerals to the signboard. The signboard is designed so that one or more characters may be mounted to the same but is such that, no matter how many or what characters are mounted, the set of characters is properly positioned, e.g., centered, with respect to the signboard. The characters are designed such that each appears properly positioned, with respect to its neighbors, no matter what it or its neighbors may be.

In one aspect, the invention is directed to an address display including a signboard, the signboard having defined therethrough at least three sets of punch-out holes, each set having at least one punch-out hole defined within, at least one punch-out hole of each set substantially collinear with at least one punch-out hole of each of the other sets, the punch-out holes along a line defined by the collinearity having substantially constant spacing; and a number of characters, each character to attach to respective ones of the at least three sets of holes, the characters each having a width and a height, the characters chosen from a set of characters corresponding to characters used in an address, each character in the set of characters having substantially the same overall width and substantially the same overall height as each of the other characters in the set of characters.

Implementations of the invention may include one or more of the following. The signboard may be mounted on a crossbeam, and the crossbeam may be mounted on one or two posts. The crossbeam may be oriented in a horizontal or vertical fashion. Each set of punch-out holes may have two or three vertically spaced holes. The number of characters which may be attached to the signboard may be one, two, three, four, five, and so on. The characters may have a trapezoidal cross-section and/or a draft in the range of 15 degrees to 20 degrees.

In another aspect, the invention is directed to a method of creating an address display sign. The method may include providing a signboard, the signboard having defined therethrough at least three sets of punch-out holes, each set having at least one punch-out hole defined within, at least one punch-out hole of each set substantially collinear with at least one punch-out hole of each of the other sets, the punch-out holes along a line defined by the collinearity having substantially constant spacing; choosing a number of characters corresponding to a number of characters in an address; punching-out or drilling out the holes of a number of the sets corresponding to the number of characters in the address; and mounting the number of characters in corresponding ones of the sets of holes, each of the characters having a width and a height, the characters chosen from a set of characters corresponding to characters used in an address, each character in the set of characters having substantially the same overall width and substantially the same overall height as each of the other characters in the set of characters.

Advantages of the invention may include one or more of the following. Multiple numbers of address or message alphanumeric characters may be accommodated within a single modular system. As the system employs punch-out holes, only the precise number of holes needed to display the desired address or message need be removed. Thus, the multiple characters may be accommodated without the unsightly holes or gaps left in prior systems. As the characters may be mounted through the signboard, they are not as susceptible to removal or dislocation as characters affixed to a signboard with magnets or other bonding agent or adhesive material. As the characters may be mounted through the signboard, the multiple characters may be accommodated without the unsightly guides used in prior systems. As the characters may be mounted using semi-permanent means, such as with a mounting screw, they can be removed, such as for cleaning, storage, refurbishment, or replacement, and/or interchanged to display a different address or message without replacement of the entire system as required in prior systems.

Other advantages will be apparent from the description that follows, including the figures and the claims.

BRIEF DESCRIPTION OF THE DRAWINGS

FIGS. 6J–6R are back plan views of numeral characters that may be employed in an address sign with accommodating numbering according to an embodiment of the present invention.

DETAILED DESCRIPTION OF THE PREFERRED EMBODIMENTS

Figure 1:
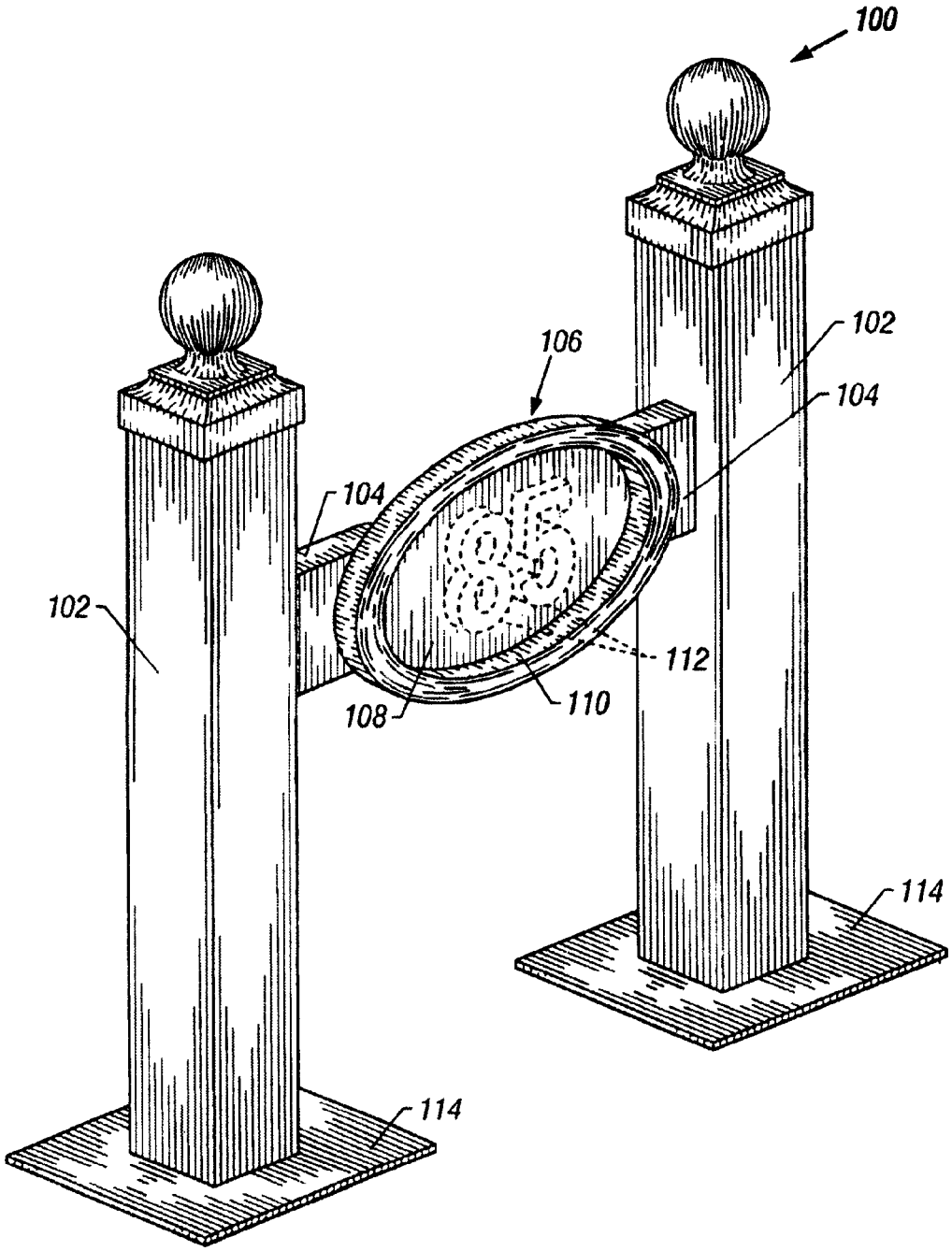
FIG. 1 is a perspective schematic view of an address sign with accommodating numbering according to an embodiment of the present invention.

As it is understood in the field of signboards that numerous types of words or phrases may be employed to mean the same or similar concepts, the following definitions are given. Of course, it will be understood that the same are intended only as guides and are not intended to be limiting of the invention.

A "post" is intended to mean any structure that supports a signboard or a crossbeam. The existence of a post is not required in some embodiments of the invention.

A "crossbeam" is intended to mean any structure that connects between a post and a signboard. The existence of a crossbeam is not required in some embodiments of the invention.

A "signboard" is intended to mean a generally flat board structure onto which alphanumeric characters, also called here just "numerals", may be mounted. The signboard may be formed of sheet metal, wood, etc.

A "character" is intended to mean an alphanumeric character. In the case of a street address, for example, the characters would typically be numerals. In the case of a message, for example, the characters would typically be letters or a combination of letters and numerals.

The term "number" is intended to mean the quantity of characters mounted onto the signboard. For example, the address having numerals "1234" has a number of characters equal to four (4).

The terms "mounted", "mount", and "mounting" are intended to mean any way in which a character may be attached to the signboard. Typically, the mounting may involve a bolt that passes through a hole in the character and a punch-out hole in the signboard. Alternatively, for example, the mounting may involve a threaded post that is welded or otherwise substantially permanently attached to the character and which is of an appropriate size to pass through the punch-out hole in the signboard. Such a post may have a nut threaded onto the same or other type of fixture to fixedly attach the post to the punch-out hole and thus to the signboard.

The term "punch-out hole" is intended to mean any indentation or hole-shaped perforation formed, for example, in a plate of sheet metal, such as a signboard, in such a way that the user may perform the final act of removing the indented or perforated portion of material and thus leaving and defining a hole. The user would typically perform this act, i.e., punching-out, prior to mounting characters to the signboard and installing the signboard at a location. To distinguish between a potential hole provided by a manufacturer and the hole as created by an end-user after removing the perforated portion of sheet metal, the former is termed herein a "punch-out hole" and the latter a "punched-out hole". A punch-out hole may also refer to a shape of a circle disposed on a plate, e.g., of sheet metal, into which a user may drill a hole of pre-defined dimension.

The term "circumferential molding" is intended to mean any type of molding providing a relief or projection to the perimeter of the signboard or providing a style or surface to the signboard that is different than the signboard alone. The term "circumferential" is intended to mean generally perimetrical and the same term should not be necessarily construed to mean circular or any other such limitation. The circumferential molding, also called a "frame", gives depth and character to the visual appearance. A variety of shapes of frames or moldings may be employed, including circles, ovals, rectangles, or combinations of these or other shapes.

Of course, it will be understood that synonyms of the above words would usually be intended to convey similar concepts, and that word variations, such as tenses, etc., would also usually be intended to convey related concepts.

Figure 2:
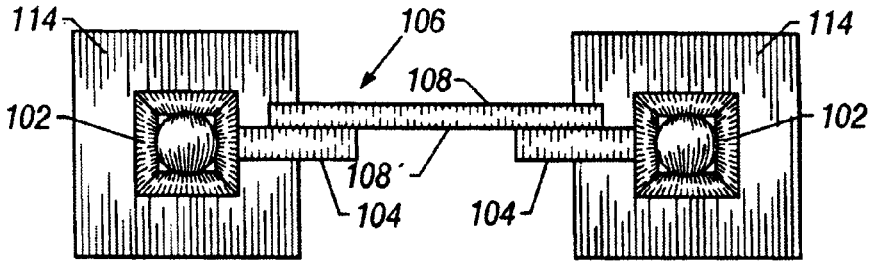
FIG. 2 is a top plan view of the address sign with accommodating numbering of FIG. 1.

Referring now to FIGS. 1 and 2, an address sign 100 includes at least one post 102 (two are shown in the figure). A crossbeam 104 is shown, mounted to each of the posts 102, to support a signboard 106 and characters 112 thereon. The crossbeam 104 may be a unitary piece attached to each of the posts 102 (not shown) or may alternatively be separate pieces 104 (as shown in more detail in FIG. 2). The posts 102 may be mounted on a stabilizer 114. However, in many permanent settings, the posts 102 may be more preferably of a "stake" variety whereby the posts are set into the ground, e.g., at a depth of about a foot or such other depth as may be preferable to provide stability to the system. The materials constituting the posts, crossbeam, and signboard may be wood, aluminum, plastic, brass, or other such rigid or semi-rigid materials as are known in the art.

Figure 3:
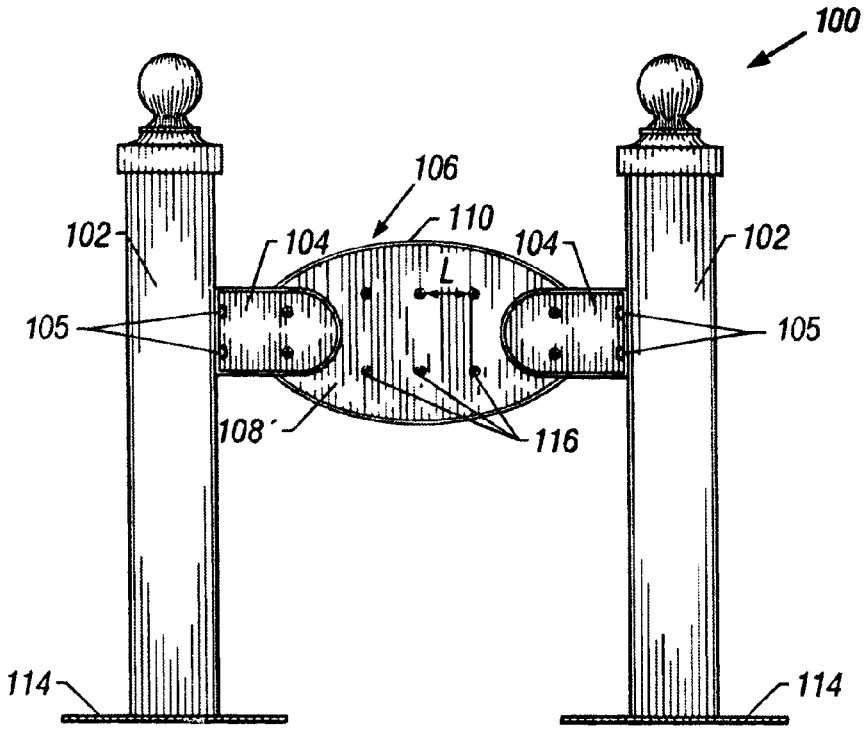
FIG. 3 is a back plan view of the address sign with accommodating numbering of FIG. 1.
Figure 4:
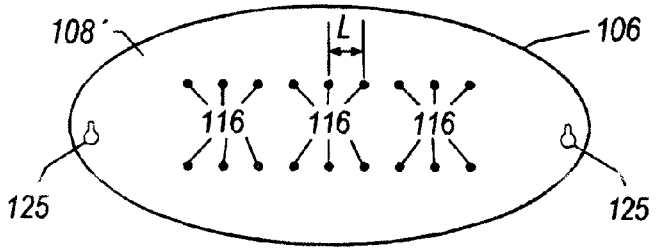
FIG. 4 is a back plan view of a signboard that may be employed in an address sign with accommodating numbering according to an embodiment of the present invention.
Figure 8:
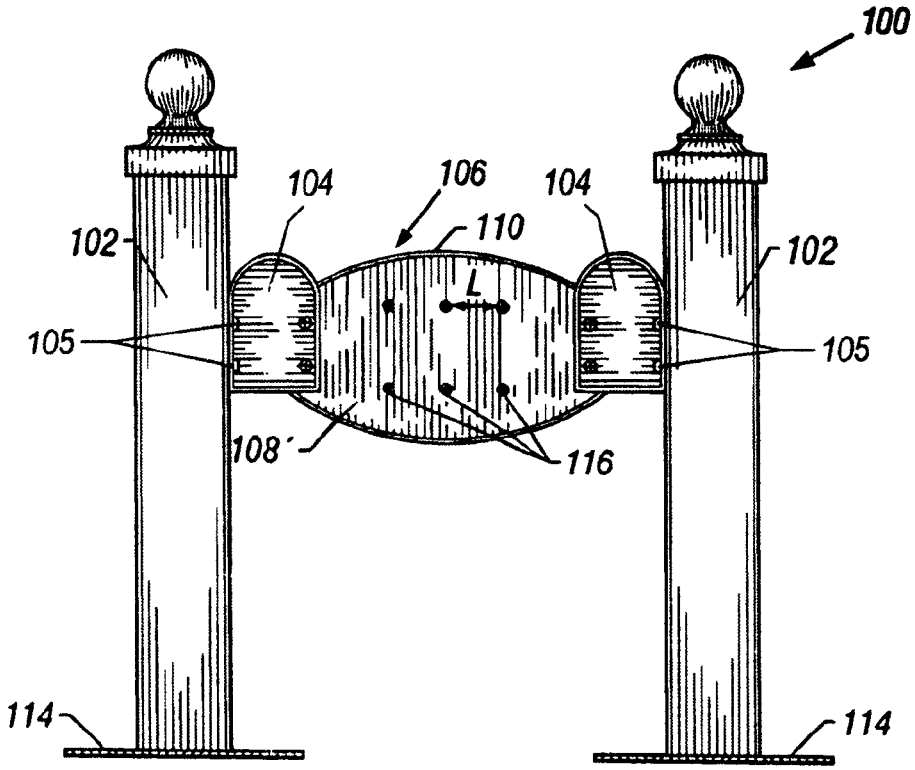
FIG. 8 is a back plan view of an address sign mounted on vertically oriented crossbeams according to an embodiment of the present invention.

One or more characters 112 may be mounted to the signboard 106, which is in turned mounted to the crossbeam 104. The crossbeam 104 in turn may be mounted to a post with bolts 105, or other attachment device, as shown in FIG. 3. The crossbeam 104 may be mounted to one or more posts 102 horizontally as depicted in FIG. 2 or vertically as depicted in FIG. 8. Of course, the signboard 106 may be mounted on one or more posts 102 directly, without a crossbeam, or may alternatively be mounted directly on a building or other fixture (not shown), or any other location on which address signs may be disposed. FIG. 4 depicts two cavities 125 which may be used in conjunction with a screw, nail, hook or other attachment device as one means of mounting the signboard 106 to another surface.

The signboard 106 may include a surface or wall 108 from which a circumferential molding 110 may depend or attach. The features of the circumferential molding are discussed above.

Referring to FIG. 3, a plurality of punch-out holes 116 may be provided in the signboard 106. The punch-out holes 116 may be employed to mount characters 112 to a wall 108. The punch-out holes 116 are shown in FIG. 3 as occurring in pairs, each pair referred to here as a "set", such that two punch-out holes 116 are provided for each character 112 to be mounted. Of course, a greater or lesser number of holes may be provided to mount each character 112 to the signboard 106.

The punch-out holes 116 may be formed by a "boss" technique such that a generally circular perforation defines each punch-out hole 116. In this way, the punch-out holes 116 may be relatively easily removed by a consumer prior to use through the use of a screwdriver, drill and/or a hammer or other such small hand-held tool. Alternatively, the punch-out holes 116 may be in actuality position-defining insignia, such as a circle drawn on the back of the signboard, into which the user would drill a hole using a small electric or hand drill.

In particular, e.g., nine sets of punch-out holes 116 may be provided as shown in more detail in FIG. 4. The punch-out holes 116 may be indexed with numerals stamped on a back side of the wall 108' of the signboard 106. These indexing numerals, which are not strictly required (the same may be described via an instruction manual, etc.), may identify which sets of holes are to be employed for different numbers of characters. For example, a "1" located over the center set of punch-out holes 116 indicates that if only one character is used in the address or message, then only that center set of punch-out holes 116 would be those used to mount that one character. If two numerals are used, e.g., the address is 21 Main Street, then two sets of punch-out holes 116, i.e., the nearest neighboring punch-out holes 116 to the punch-out holes 116 corresponding to the "1" indexing numeral above, would be used. Extensions of this system to three characters, four characters, five characters, and so on may be seen to be clear from the teaching of this specification.

It should be evident from this teaching that, for example, for four numerals, the punch-out holes 116 corresponding to "4" are used, along with the punch-out holes 116 corresponding to "2". Similarly, for five numerals, the punch-out holes 116 corresponding to "5" are used, along with the punch-out holes 116 corresponding to "3" numerals, along with the punch-out hole 116 corresponding to "1".

The punch-out holes 116 are equidistantly spaced such that an even spacing "L" between the characters is maintained as depicted on FIG. 4.

The even spacing "L" between the characters 112 may be related to the size of the characters 112 themselves in a special way. Further, each character's size may be related to the size of the other characters 112 in a special way.

Figure 5A:
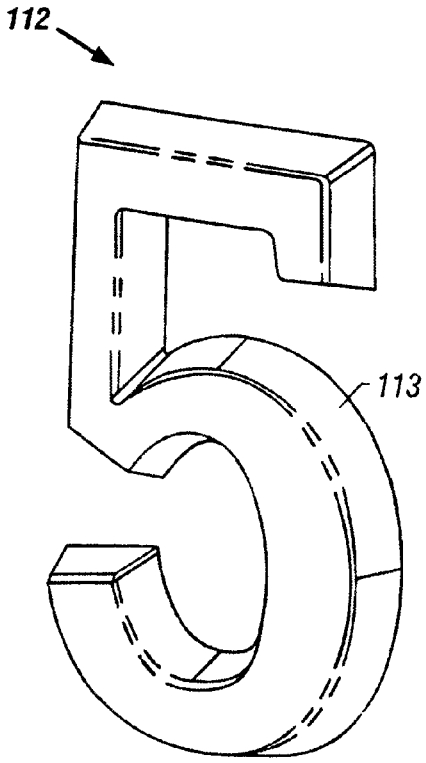
FIGS. 5A and 5B are front and back perspective views, respectively, of a numeral character that may be employed in an address sign with accommodating numbering according to an embodiment of the present invention.
Figure 5B:
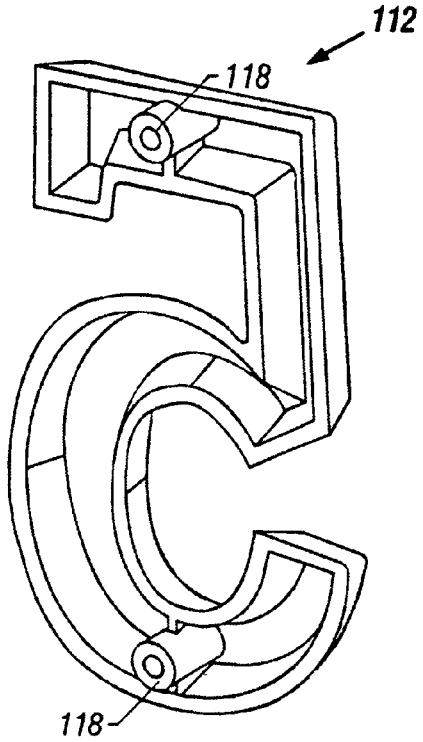
Figure 6A:
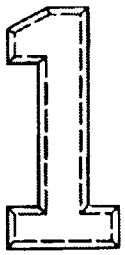
FIGS. 6A–6I are front plan views of numeral characters that may be employed in an address sign with accommodating numbering according to an embodiment of the present invention.
Figure 6B:
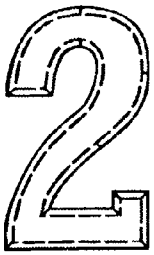
Figure 6C:
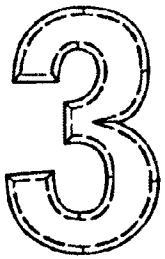
Figure 6D:
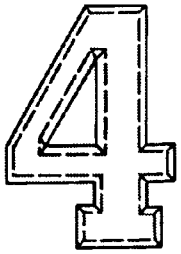
Figure 6E:
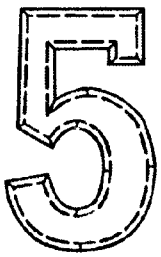
Figure 6F:
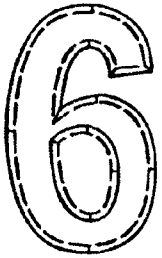
Figure 6G:
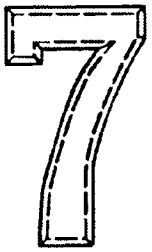
Figure 6H:
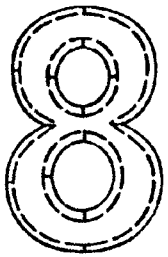
Figure 6L:
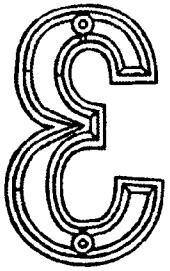
Figure 6K:
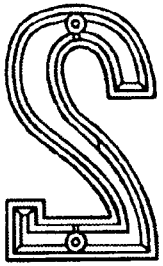
Figure 6J:
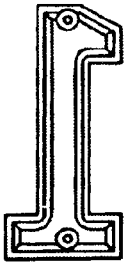
Figure 6I:
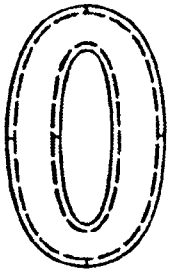
Figure 6P:
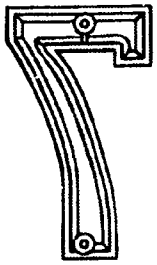
Figure 6O:
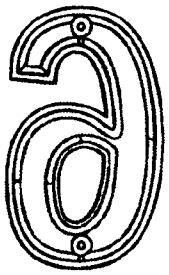
Figure 6N:
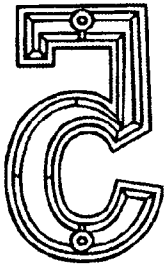
Figure 6M:
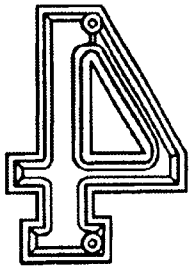
Figure 6O:
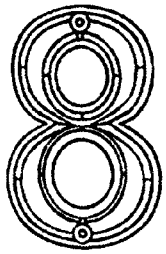
Figure 6R:
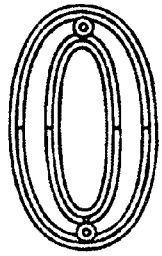

More specifically, and referring to FIGS. 5–7, each character 112, e.g., numerals, has a width "w", a height "h", and a depth "d". Each character 112 further has at least one receiving hole 118 for receiving a screw or other such fastener (not shown) that is also incident through a punched-out hole 116. Of course, it will be recognized by one of ordinary skill in the art, given the teachings herein, that other types of fasteners, other than screws, may be employed for this same purpose. For example, a frictional-fit plug-and-hole system may be employed to secure the characters to the signboard.

The depth "d" and height "h" of the characters 112 may be maintained constant, as between different characters 112, to provide an attractive presentation. The width "w" of each character 112 may be denoted as $W_1$, $W_2$, $W_3$, etc., for the width of the numeral "1", the width of the numeral "2", the width of the numeral "3", etc., respectively. Generally, the character 112 may be provided such that $W_1=W_2=W_3=\ldots=W_0$. That is, each alphanumerical character may be described as being of a size just sufficient to fit in a rectangle, where the contours of the character are such that the contours touch or are tangential to the sides of the rectangle, but where the contours do not extend outside the rectangle. In this case, the rectangles corresponding to each of the numerals are substantially the same size, i.e., substantially the same overall height and substantially the same overall width.

Thus, in general, each character may be attached to the signboard with a set of mounting screws passing through a respective set of holes. Each signboard may have 3, 4, 5, or more sets, e.g., pairs, of mounting holes which are equally spaced in a collinear fashion so that 1 to 5, or even more, characters can be attached such that an even spacing is maintained between the characters. The line of collinearity may be, e.g., horizontal or vertical, although one of skill in the art, given the teaching of this specification, will recognize that deviations from this may be accomplished without varying from the scope of the invention.

In general, characters are spaced such that combinations of characters are centered on the signboard. If one character only is used, that character would be centered on the signboard. If two characters are used, each would be equally spaced from the centerline of the signboard. If three, one is centered on the signboard and the others are equally spaced from the centerline of the signboard. Extensions of this scheme are thus apparent.

Figure 7A:
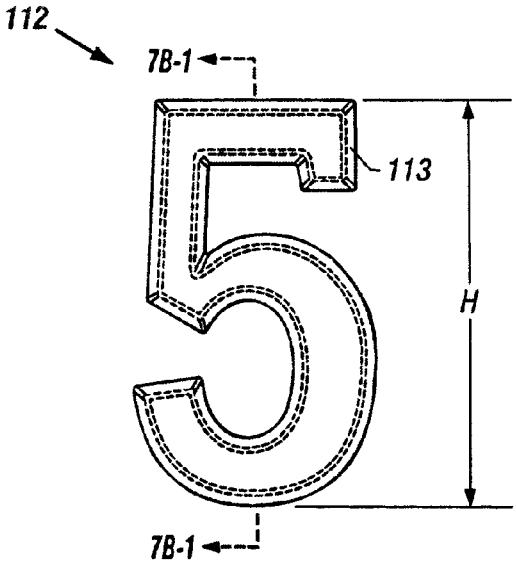
FIGS. 7A–7D are front, side, back and top plan views, respectively, of a numeral character that may be employed in an address sign with accommodating numbering according to an embodiment of the present invention.
Figures 1, 7B:
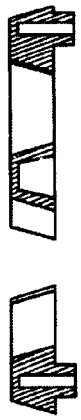
Figures 2, 7B:
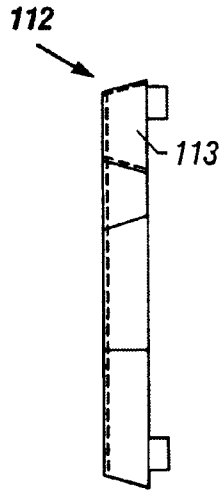
Figure 7C:
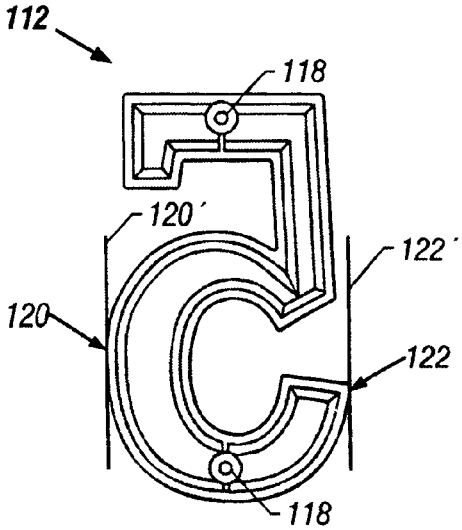
Figure 7D:
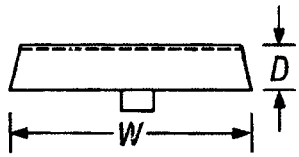

In some cases, it may be desirable to have certain characters 112 vary from this guideline; e.g., the "1," "I" or other characters 112 may be somewhat narrower than the other characters 112. In the general case but especially in the case where the "1" is somewhat narrower than the other numerals 112, the receiving holes 118 may be located relative to the numeral 112 such that each bisects the width of the numeral 112. In other words, the width of each numeral 112 may be defined by two "widest" points 120 and 122, as shown in FIG. 7C, and a vertical line may be defined as passing through each of points 120 and 122, the vertical lines denoted as lines 120' and 122', respectively, in the figure. The receiving holes 118 then fall halfway between lines 120' and 122'.

The numerals or other characters may also be provided with an enhanced "draft" in order to accentuate light reflections off of the same, thus creating a more pleasing appearance. As shown best in FIG. 7B-1 and 7B-2, but also shown in FIG. 5A and FIG. 7A, the draft 113 may be made extreme, e.g., 15°–20°. This allows more extreme reflections, creating the appearance of depth and a more pleasing design. A similar effect may be provided on the molding 110.

It will be understood that the above description of an Address Sign With Accommodating Characters has been with respect to particular embodiments of the invention. While this description is fully capable of attaining the objects of the invention, it is understood that the same is merely representative of the broad scope of the invention envisioned, and that numerous variations of the above embodiments may be known or may become known or are obvious or may become obvious to one of ordinary skill in the art, and these variations are fully within the broad scope of the invention. For example, while the invention has been described in the context of a particular font, i.e., Rockwell Bold, other fonts may be similarly modified according to the teaching herein. And while the "set" of holes disclosed herein has referred to a pair of holes, i.e., two holes, each character may be attached to the signboard, via a mounting screw, with a greater or lesser number of holes and respective screws. Accordingly, the scope of the invention is to be limited only by the claims appended hereto, and equivalents thereof. In these claims, a reference to an element in the singular is not intended to mean "one and only one" unless explicitly stated. Rather, the same is intended to mean "one or more". All structural and functional equivalents to the elements of the above-described preferred embodiment that are known or later come to be known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present invention is intended to be dedicated to the public regardless of whether the element, component, or method step is explicitly recited in the claims. No claim element herein is to be construed under the provisions of 35 U.S.C. §§112, ¶6, unless the element is expressly recited using the phrase "means for".

The invention claimed is:

1. An address display, comprising:

a signboard, the signboard having defined thereon at least three sets of punch-out holes, each set having at least one punch-out hole defined within, at least one punch-out hole of each set substantially collinear with at least one punch-out hole of each of the other sets, the punch-out holes being along a line defined by said collinearity having substantially constant spacing; and a number of characters, each character to attach to respective ones of said at least three sets of holes, said characters each having a width and a height, the characters chosen from a set of characters corresponding to characters used in an address, each character in the set of characters having substantially the same width and substantially the same height as each of the other characters in the set of characters.

2. The display of claim 1, wherein the signboard is mounted on a crossbeam.

3. The display of claim 2, wherein the crossbeam is mounted on a post.

4. The display of claim 3, wherein the crossbeam is oriented in a vertical fashion.

5. The display of claim 3, wherein the crossbeam is oriented in a horizontal fashion.

6. The display of claim 2, wherein the crossbeam is mounted on two posts.

7. The display of claim 1, wherein each set of punch-out holes has two vertically spaced holes.

8. The display of claim 7, wherein the number of sets of punch-out holes is chosen from the set consisting of: three, four, and five.

9. The display of claim 1, wherein each character has a trapezoidal cross-section.

10. The display of claim 1, wherein each character has a draft in the range of 15 degrees to 20 degrees.

11. The display of claim 1, wherein no holes in said signboard are visible when the display is positioned to permit viewing of said characters.

12. The display of claim 1, wherein no said punch-out holes are visible when the display is positioned to permit viewing of said characters.

13. A method for creating an address display, comprising:

providing a signboard, the signboard having defined thereon at least three sets of punch-out holes, each set having at least one punch-out hole defined within, at least one punch-out hole of each set substantially collinear with at least one punch-out hole of each of the other sets, the punch-out holes being along a line defined by said collinearity having substantially constant spacing;

choosing a number of characters corresponding to a number of characters in an address, said characters each having a width and a height, said characters chosen from a set of characters corresponding to characters used in an address, each character in said set of characters having substantially the same width and substantially the same height as each of the other characters in said set of characters;

choosing from the sets of punch-out holes a desired location on the signboard for each character chosen;

punching-out the holes of a number of the sets of punch-out holes corresponding to the number of characters chosen and to the desired location of the character(s) on the signboard; and mounting the number of characters chosen onto the signboard, with each character being mounted using the set of punched-out holes corresponding to its desired location on the signboard.

14. The method of claim 13, further comprising mounting the signboard on a crossbeam.

15. The method of claim 14, further comprising mounting the crossbeam on a post.

16. The method of claim 15, further comprising mounting the crossbeam in a vertical orientation.

17. The method of claim 15, further comprising mounting the crossbeam in a horizontal orientation.

18. The method of claim 14, further comprising mounting the crossbeam on two posts.

19. The method of claim 13, wherein the punching-out includes punching-out two vertically spaced holes for each set of punch-out holes.

20. The method of claim 19, wherein the punching-out includes punching-out two vertically spaced holes for a number of sets of punch-out holes, wherein the number is chosen from the set consisting of: three, four, and five.

21. The method of claim 13, further comprising choosing a number of characters, wherein each character chosen has a trapezoidal cross-section.

22. The method of claim 13, further comprising choosing a number of characters, wherein each character chosen has a draft in the range of 15 degrees to 20 degrees.

23. The method of claim 13, wherein said characters are attached to said signboard such that said punched-out holes are not visible when the display is positioned to permit viewing of said characters.

24. The method of claim 13, wherein said characters are attached to said signboard through said punched-out holes by an attachment means such that said attachment means is not visible when the display is positioned to permit viewing of said characters.

* * * * *